US010027023B1

(12) United States Patent
Kim et al.

(10) Patent No.: US 10,027,023 B1
(45) Date of Patent: Jul. 17, 2018

(54) EMBEDDED MULTI-BAND ANTENNA IN A BAND OF A WEARABLE ELECTRONIC DEVICE

(71) Applicant: Amazon Technologies, Inc., Seattle, WA (US)

(72) Inventors: Namhoon Kim, San Jose, CA (US); Adrian Napoles, Cupertino, CA (US)

(73) Assignee: Amazon Technologies, Inc., Seattle, WA (US)

( * ) Notice: Subject to any disclaimer, the term of this patent is extended or adjusted under 35 U.S.C. 154(b) by 314 days.

(21) Appl. No.: 15/059,537

(22) Filed: Mar. 3, 2016

(51) Int. Cl.

| | |
|---|---|
| ***H01Q 1/27*** | (2006.01) |
| ***H01Q 1/24*** | (2006.01) |
| ***H01Q 5/00*** | (2015.01) |
| ***H01Q 5/20*** | (2015.01) |

(52) U.S. Cl.
CPC ..... *H01Q 1/273* (2013.01); *H01Q 1/243* (2013.01); *H01Q 5/20* (2015.01)

(58) Field of Classification Search
CPC H01Q 1/273; H01Q 5/20; H01Q 5/30; H01Q 5/307; H01Q 5/342; H01Q 5/357; H01Q 5/364; H01Q 5/371
See application file for complete search history.

(56) References Cited

U.S. PATENT DOCUMENTS

| | | | | |
|---|---|---|---|---|
| 4,922,260 | A | 5/1990 | Gaskill et al. | |
| 5,179,733 | A | 1/1993 | Matsui | |
| 5,499,398 | A * | 3/1996 | Kudoh | H01Q 1/273 455/290 |
| 5,986,566 | A | 11/1999 | Yamamori | |
| 9,160,056 | B2 | 10/2015 | Nickel et al. | |
| 2015/0378321 | A1 * | 12/2015 | Fraser | G04G 21/04 368/10 |

* cited by examiner

*Primary Examiner* — Daniel J Munoz
(74) *Attorney, Agent, or Firm* — Lowenstein Sandler LLP

(57) ABSTRACT

Antenna structures and methods of operating the same of an electronic device are described. One wearable electronic device includes a housing of conductive material and an antenna structure disposed on or within a band that is used to affix to a user. The antenna structure includes a first connector, a second connector, and a first antenna element. The first and second connectors extend out from sides of the band and electrically couple to a RF feed and a ground point when the first and second connectors are physically coupled to the housing. The RF circuitry is operable to cause a first current flow on at least the first antenna element via the first connector to radiate electromagnetic energy in a first frequency range.

20 Claims, 10 Drawing Sheets

806
804
802

809
808
With one antenna arm 811
810

806
814
816
812

804
819
818
With two antenna arms 804
821
820

806
804
822
824
823

826
828
830
825
With three or four antenna arms 804
832
834
836
831

900

EMBEDDED MULTI-BAND ANTENNA IN A BAND OF A WEARABLE ELECTRONIC DEVICE

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

FIG. 9 is a graph of the $S_{11}$ parameter, $S_{22}$ parameter, and $S_{12}$ parameter according to one embodiment.

DETAILED DESCRIPTION

Figure 1:
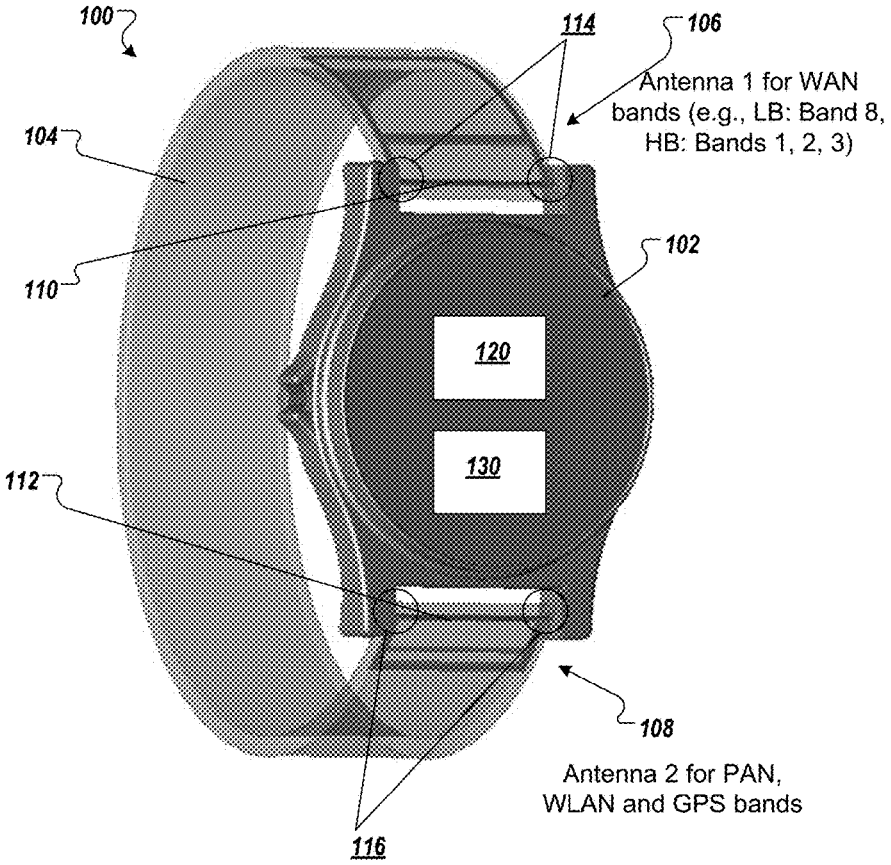
FIG. 1 is a perspective view of a smartwatch having ladder antenna structures embedded in a watchband according to one embodiment.

Antenna structures and methods of operating the same of an electronic device are described. One wearable electronic device includes a housing of conductive material and an antenna structure disposed on or within a band that is used to affix to a user. The antenna structure includes a first connector, a second connector, and a first antenna element. The first and second connectors extend out from sides of the band and electrically couple to a RF feed and a ground point when the first and second connectors are physically coupled to the housing. The RF circuitry is operable to cause a first current flow on at least the first antenna element via the first connector to radiate electromagnetic energy in a first frequency range.

Some of the embodiments described herein are directed to antenna structures formed as embedded ladder structures disposed on or within a watchband of a smartwatch. The smartwatch has a metal watch body and a non-metal watchband. It should be noted that the non-metal watchband may be entirely non-metal in some cases, excluding possibly the clasp or securing mechanism opposite the metal watch body. In other implementations, the watchband may have portions that are metal (or other conductive material) and portions that are non-metal (or other non-conductive material). Antenna structures, as described herein, may be disposed in connection with the portions that have non-conductive material and the portions that have conductive material can be disposed in some locations depending on the distances from the antenna structures. Also, the shape of the antenna structure can influence where the metal portions can be located on the watchband. Similarly, in some cases, the smartwatch may include a metal watch body. In other cases, the smartwatch may include a plastic watch body or a watch body made of non-conductive material. In these cases, a ground plane of a circuit board disposed within the housing can be used as a ground plane for the antenna structures. In other embodiments, conductive material can be disposed within or on the housing to operate as a ground plane for the antenna structures. For example, metal coating can be disposed on an inner wall of a plastic housing. Alternatively, an insert of conductive material can be disposed on an inner wall of a housing of non-conductive material. In other embodiments, a device includes a metal body and a non-metal member. One or more ends of the non-metal member can be affixed to the metal body. The antenna structures descried herein can be embedded within or disposed on the non-member.

In some embodiments, a first end of the non-metal watchband is affixed to the metal watch body via a first metal spring bar and a second end of the non-metal watchband is affixed to the metal watch body via a second metal spring bar. A processor and RF circuitry are disposed within the metal watch body and the RF circuitry includes an RF feed and a grounding point. One or more antenna structures may be formed as ladder structure within the non-metal watchband. The ladder structure includes a first rail of metal coupled to the RF feed via a first pin of the first metal spring bar, a second rail of metal coupled to the grounding point via a second pin of the second metal spring bar, and multiple elements disposed in parallel lines between the first rail and the second rail. The parallel lines are perpendicular to the length of the non-metal watchband. The RF circuitry is operable to cause the first antenna structure to radiate electromagnetic energy in one or more frequency bands, as described herein. In other embodiments, the RF circuitry may include one or more of a wireless area network (WAN) module, a wireless local area network (WLAN) module, a global positioning system (GPS) module, a personal area network (PAN) module, or the like. These one or more modules can be operable to cause the one or more ladder antenna structures to radiate electromagnetic energy in one or more WAN frequency bands, WLAN frequency bands, GPS frequency bands, PAN frequency bands, or the like.

FIG. 1 is a perspective view of a smartwatch 100 having ladder antenna structures embedded in a watchband according to one embodiment. The smartwatch 100 includes a metal watch body 102 and a non-metal watchband 104. A first end of the non-metal watchband 104 is affixed to the metal watch body 102 via a first metal spring bar 110. A second end of the non-metal watchband 104 is affixed to the metal watch body 102 via a second metal spring bar 112. A processor 120 and a RF chipset 130 are disposed within the metal watch body 102. A first embedded ladder antenna structure 106 is embedded within or on the first end of the non-metal watchband 104. A second embedded ladder antenna structure 108 is embedded within or on the second end of the non-metal watchband. The RF chipset 130 (also referred to herein as RF circuit, RF circuitry or radio) is electrically coupled to the first embedded ladder antenna structure 106 and the second embedded ladder antenna structure 108 using multiple antenna contact terminals 114, 116. A first set of antenna contact terminals 114 may be a first RF feed and a first grounding point coupled to the first embedded ladder antenna structure 106. A second set of antenna contact terminals 116 may be a second RF feed and a second grounding point coupled to the second embedded ladder antenna structure 108. Additional details of the first embedded ladder antenna structure 106 and the second embedded ladder antenna structure 108 as described below with respect to FIGS. 2-3, respectively.

The RF chipset 130 is operable to cause the first embedded ladder antenna structure 106, the second embedded ladder antenna structure 108, or both to radiate electromagnetic energy in one or more frequency bands, as described herein. In particular, the RF chipset 130 causes a current flow on one or more of the antenna structures to cause the antenna structure(s) to radiate electromagnetic energy in one or more radiation patterns. For example, the RF chipset 130 can apply a RF signal to the first RF feed that causes a first current flow on the first embedded ladder antenna structure 106 to achieve a first radiation pattern of electromagnetic energy in a first resonant mode. The RF chipset 130 can apply a separate RF signal to the first RF feed that causes a second current flow on the first embedded ladder antenna structure 106 to achieve a second radiation pattern of electromagnetic energy in a second resonant mode. Alternatively, the RF chipset 130 can apply one or more RF signals to the antenna structures to achieve other resonant modes, as described herein. In one embodiment, the first embedded ladder antenna structure 106 is self-resonant at WAN frequency bands, such as the Band 8, Band 1, Band 2, Band 3, or the like, and the second embedded ladder antenna structure 108 is self-resonant at WLAN, PAN, GPS frequency bands, or the like. Alternatively, the embedded ladder antenna structures can be designed to be self-resonant at other frequency bands.

In one embodiment, the RF chipset 130 includes a WAN module that is operable to cause the first embedded ladder antenna structure 106 to radiate electromagnetic energy in a first frequency range (e.g., approximately 700 MHz to approximately 1 GHz) in a first resonant mode (e.g., low-band (LB)) and cause the first embedded ladder antenna structure 106 to radiate electromagnetic energy in a second frequency range (e.g., approximately 1.7 GHz to approximately 2.2 GHz) in a second resonant mode (e.g., high-band (HB)). These modes can be further matched to desired working bands of interest. In another embodiment, the RF chipset 130 includes a WLAN module that is operable to cause the second embedded ladder antenna structure 108 to radiate electromagnetic energy in a third frequency range (e.g., approximately 2.4 GHz to approximately 2.5 GHz) in a third resonant mode (e.g., BT/Wi-Fi modes using the Wi-Fi® or Bluetooth® technologies). A GPS module can be operable to cause the second embedded ladder antenna structure 108 to radiate electromagnetic energy in a fourth frequency range (e.g., approximately 1.5 GHz to approximately 1.6 GHz) in a fourth resonant mode (e.g., GPS mode). These modes can be further matched to desired working bands of interest. For example, in dual-band Wi-Fi® networks, the first embedded ladder antenna structure 106 can be matched in the two modes to cover the 2.4 GHz band and the 5 GHz band. For example, the WLAN module may include a WLAN RF transceiver for communications on one or more Wi-Fi® bands (e.g., 2.4 GHz and 5 GHz). It should be noted that the Wi-Fi® technology is the industry name for wireless local area network communication technology related to the IEEE 802.11 family of wireless networking standards by Wi-Fi Alliance. For example, a dual-band WLAN RF transceiver allows an electronic device to exchange data or connection to the Internet wireless using radio waves in two WLAN bands (2.4 GHz band, 5 GHz band) via one or multiple antennas. For example, a dual-band WLAN RF transceiver includes a 5 GHz WLAN channel and a 2.4 GHz WLAN channel. In other embodiments, the antenna architecture may include additional RF modules and/or other communication modules, such as a GPS receiver, a near field communication (NFC) module, a PAN modules that implements the Bluetooth® or Zigbee® technologies, an amplitude modulation (AM) radio receiver, a frequency modulation (FM) radio receiver, a Global Navigation Satellite System (GNSS) receiver, or the like. The RF chipset 130 may include one or multiple RFFE (also referred to as RF circuitry). The RFFEs may include receivers and/or transceivers, filters, amplifiers, mixers, switches, and/or other electrical components. In another embodiment, the radio is a WLAN radio. It should be noted that in other embodiments, the RF chipset 130 can uses the first embedded ladder antenna structure 106 and the second embedded ladder antenna structure 108 in different multiple-input, multiple-output (MIMO) configurations, diversity configurations, or the like.

The RF chipset 130 may be coupled to a modem that allows the smartwatch 100 to handle both voice and non-voice communications (such as communications for text messages, multimedia messages, media downloads, web browsing, etc.) with a wireless communication system. The modem may provide network connectivity using any type of digital mobile network technology including, for example, LTE, LTE advanced (4G), CDPD, GPRS, EDGE, UMTS, 1×RTT, EVDO, HSDPA, WLAN (e.g., Wi-Fi® network), etc. In the depicted embodiment, the modem can use the RF chipset 130 to radiate or receive electromagnetic energy on the antennas to communication data to and from the smartwatch 100 in the respective frequency ranges. In other embodiments, the modem may communicate according to different communication types (e.g., WCDMA, GSM, LTE, CDMA, WiMAX, etc.) in different cellular networks.

The smartwatch 100 (also referred to herein as an electronic device) may be any wearable electronic device that includes a modem for connecting the wearable electronic device to a network. Examples of such electronic devices include smartwatches, portable wearable computers, portable media players, wearable cellular devices, and the like. The wearable electronic device may connect to a network to obtain content from a server computing system (e.g., an item providing system) or to perform other activities. The wearable electronic device may connect to one or more different types of cellular networks.

Figure 2:
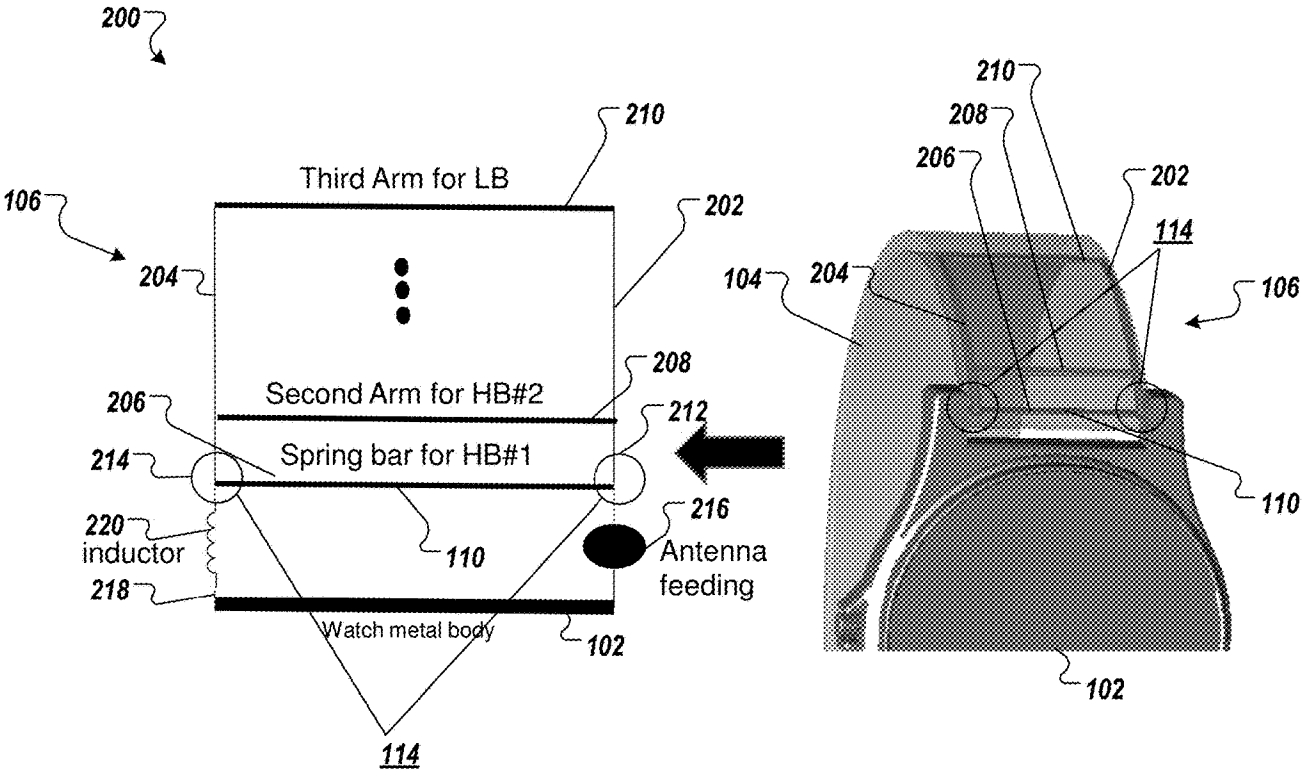
FIG. 2 is a schematic diagram of a first ladder antenna structure embedded in a first end of the watchband according to one embodiment.

FIG. 2 is a schematic diagram 200 of a first ladder antenna structure 106 embedded in a first end of the watchband 104 according to one embodiment. The first ladder antenna structure 106 (hereinafter referred to as first antenna structure 106) is embedded within or disposed on the first side of the non-metal watchband 104. The first antenna structure 106 is electrically coupled to the RF circuitry 130 via the first metal spring bar 110. The first metal spring bar 110 may include a first pin and a second pin that operate as first and second connectors 212, 214. The first connector 212 may include at least a portion of conductive material that is electrically coupled to an RF feed 216 when the first connector 212 is physically coupled to the metal watch body 102. The second connector 214 may include at least a portion of conductive material that is electrically coupled to a grounding point 218 when the second connector 214 is physically coupled to the metal watch body 102. The first metal spring bar 110 can make a mechanical connection, as well as an electrical connection. Since the spring bar 110 is metal itself, it can conduct current to operate as a radiator as well. In one embodiment, an inductor 220 may be disposed between the second connector 214 and the grounding point 218.

In the depicted embodiment, the first antenna structure 106 includes a first arm 202, a second arm 204, a third arm 206, a fourth arm 208, and a fifth arm 210. The first arm 202 extends along a first line that is equidistant from a first side of the non-metal watchband 104. The second arm 204 extends along a second line that is equidistant from a second side of the non-metal watchband 104. The third arm 206 extends along a third line that is equidistant from an axis of the first metal spring bar. In the depicted embodiment, the third arm 206 includes the first metal spring bar 110. As described herein, the first metal spring bar 110 radiates in a first resonant mode as a radiator. The fourth arm 208 extends along a fourth line that is equidistant from the axis of the first metal spring bar 110. The fifth arm 210 extends a long a fifth line that is equidistant from the axis of the first metal spring bar 110. The fourth arm 208 is disposed at a greater distance from the metal watch body 102 than the third arm 206. The fifth arm 210 is disposed at a greater distance from the metal watch body 102 than the fourth arm 208. In other embodiments, the first antenna structure 106 can include any combination of the third arm 206, fourth arm 208, and fifth arm 210. It should also be noted that references to first, second, third, and so forth are used to differentiate the different elements from one another and are not used in the strict ordinal sense.

During operation of the smartwatch 100, the RF circuitry 130 causes a first current flow on or through a portion of the first arm 202, a portion of the second arm 204, the third arm 206, and a first portion of the metal watch body 102 (when used as a ground plane) to collectively radiate electromagnetic energy in a first frequency range. The first current can generate a first radiation pattern of electromagnetic energy in a first resonant mode (e.g., HB#1). The RF circuitry 130 can cause a second current flow on the first arm 202, the second arm 204, the fourth arm 208, and the first portion of the metal watch body 102 to collectively radiate electromagnetic energy in a second frequency range. The second current can generate a second radiation pattern of electromagnetic energy in a second resonant mode (e.g., HB#2). The second frequency range may be lower than the first frequency range. An overall length of the first arm 202, the second arm 204, and the fourth arm 208 may be greater than an overall length of the portion of the first arm 202, the second arm 204, and the third arm 206. In the case of the third arm 206 being the metal spring bar 110, the overall length may not include significant portions, if at all, of the first arm 202 and the second arm 204. The RF circuitry 130 can cause a third current flow on the first arm 202, the second arm 204, the fifth arm 210, and the first portion of the metal watch body 102 to collectively radiate electromagnetic energy in a third frequency range. The third current can generate a third radiation pattern of electromagnetic energy in a third resonant mode (e.g., LB). The third frequency range may be lower than the first frequency range and the second frequency range. An overall length of the arms including the fifth arm 210 may be greater than an overall length of the arms with the fourth arm 208.

Figure 3:
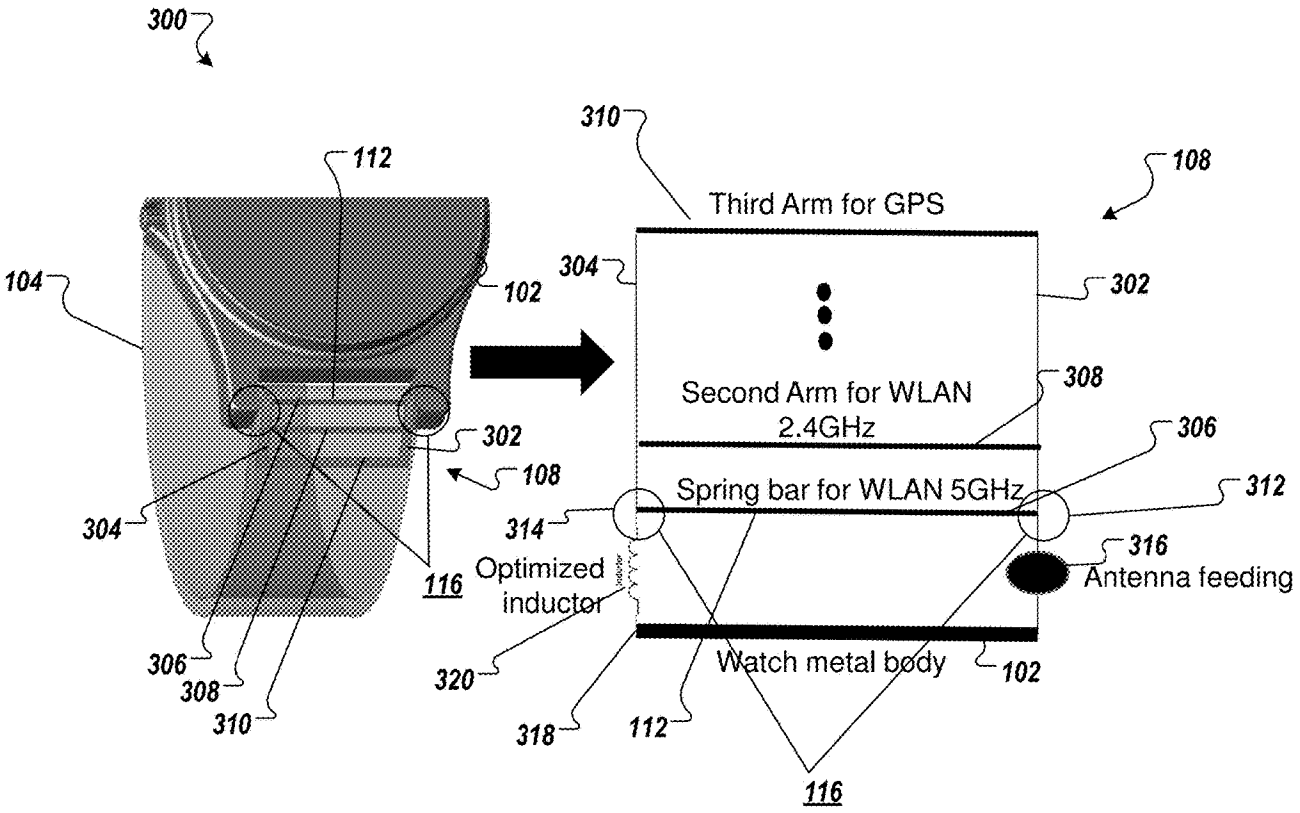
FIG. 3 is a schematic diagram of a second ladder antenna structure embedded in a second end of the watchband according to one embodiment.

FIG. 3 is a schematic diagram 300 of a second ladder antenna structure 108 embedded in a second end of the watchband 104 according to one embodiment. The second ladder antenna structure 108 (hereinafter referred to as second antenna structure 108) is embedded within or disposed on the send end of the non-metal watchband 104. The second antenna structure 108 is electrically coupled to the RF circuitry 130 via the second metal spring bar 112. The second metal spring bar 112 may include a first pin and a second pin that operate as first and second connectors 312, 314. The first connector 312 may include at least a portion of conductive material that is electrically coupled to an RF feed 316 when the first connector 312 is physically coupled to the metal watch body 102. The second connector 314 may include at least a portion of conductive material that is electrically coupled to a grounding point 318 when the second connector 314 is physically coupled to the metal watch body 102. The second metal spring bar 112 can make a mechanical connection, as well as an electrical connection. Since the second spring bar 112 is metal itself, it can conduct current to operate as a radiator as well. In one embodiment, an inductor 320 may be disposed between the second connector 314 and the grounding point 318.

In the depicted embodiment, the second antenna structure 108 includes a first arm 302, a second arm 304, a third arm 306, a fourth arm 308, and a fifth arm 310. The first arm 302 extends along a first line that is equidistant from the first side of the non-metal watchband 104. The second arm 304 extends along a second line that is equidistant from the second side of the non-metal watchband 104. The third arm 306 extends along a third line that is equidistant from an axis of the second metal spring bar 112. In the depicted embodiment, the third arm 306 includes the second metal spring bar 112. As described herein, the second metal spring bar 112 radiates in a first resonant mode as a radiator. The fourth arm 308 extends along a fourth line that is equidistant from the axis of the second metal spring bar 112. The fifth arm 310 extends a long a fifth line that is equidistant from the axis of the second metal spring bar 112. The fourth arm 308 is disposed at a greater distance from the metal watch body 102 than the third arm 306. The fifth arm 310 is disposed at a greater distance from the metal watch body 102 than the fourth arm 308. In other embodiments, the second antenna structure 108 can include any combination of the third arm 306, fourth arm 308, and fifth arm 310. It should also be noted that references to first, second, third, and so forth are used to differentiate the different elements from one another and are not used in the strict ordinal sense.

During operation of the smartwatch 100, the RF circuitry 130 causes a first current flow on or through a portion of the first arm 302, a portion of the second arm 304, the third arm 306, and a first portion of the metal watch body 102 to collectively radiate electromagnetic energy in a first frequency range. The first current can generate a first radiation pattern of electromagnetic energy in a first resonant mode (e.g., WLAN 5 GHz). The RF circuitry 130 can cause a second current flow on the first arm 302, the second arm 304, the fourth arm 308, and the first portion of the metal watch body 102 to collectively radiate electromagnetic energy in a second frequency range. The second current can generate a second radiation pattern of electromagnetic energy in a second resonant mode (e.g., WLAN 2.4 GHz). The second frequency range may be lower than the first frequency range. An overall length of the first arm 302, the second arm 304, and the fourth arm 308 may be greater than an overall length of the portion of the first arm 302, the second arm 304, and the third arm 306. In the case of the third arm 306 being the metal spring bar 112, the overall length may not include significant portions, if any at all, of the first arm 302 and the second arm 304. The RF circuitry 130 can cause a third current flow on the first arm 302, the second arm 304, the fifth arm 310, and the first portion of the metal watch body 102 to collectively radiate electromagnetic energy in a third frequency range. The third current can generate a third radiation pattern of electromagnetic energy in a third resonant mode (e.g., GPS). The third frequency range may be lower than the first frequency range and the second frequency range. An overall length of the arms including the fifth arm 310 may be greater than an overall length of the arms with the fourth arm 208.

In other embodiments, the RF circuitry includes one or more WAN modules, one or more WLAN modules, and a GPS receiver. In one embodiment, the WAN module is operable to cause the first antenna structure 106 to radiate electromagnetic energy in the first frequency range, the second frequency range, or both concurrently. In this embodiment, the first frequency range and the second frequency range are WAN frequency bands. In a further embodiment, the WAN module is operable to cause the first antenna structure 106 to radiate electromagnetic energy in the first frequency range, the second frequency range, a third frequency range, or any combination thereof concurrently or sequentially. The third frequency range maybe another WAN frequency band. In another embodiment, the WLAN module is operable to cause the second antenna element 108 to radiate electromagnetic energy in the first frequency range, the second frequency range, or both concurrently. In this embodiment, the first frequency range and the second frequency range are WLAN frequency bands, PAN frequency bands, or the like. In another embodiment, the GPS module is coupled to the second antenna structure 108 and is operable to cause the second antenna element 108 to radiate electromagnetic energy in a third frequency range. In a further embodiment, the WLAN module and the GPS module are operable to cause the second antenna structure 108 to radiate electromagnetic energy in the first frequency range, the second frequency range, the third frequency range, or any combination thereof concurrently or sequentially.

In another embodiment, the smartwatch 100 may include a first antenna structure formed as a ladder structure within a first end of the non-metal watchband. The first end of the non-metal watchband is affixed to the metal watch body via a first metal spring bar. The ladder structure may include 1) a first rail of metal coupled to the RF feed via a first pin of the first metal spring bar; 2) a second rail of metal coupled to the grounding point via a second pin of the second metal spring bar; and 3) two or more elements disposed in parallel lines between the first rail and the second rail. The parallel lines are perpendicular to the length of the non-metal watchband. In this embodiment, the RF circuitry is operable to cause the first antenna structure to radiate electromagnetic energy in multiple frequency bands, as described herein.

In a further embodiment, a second antenna structure is formed as a second ladder structure within a second end of the non-metal watchband. The second end of the non-metal watchband is affixed to the metal watch body via a second metal spring bar. The second ladder structure includes: 1) a third rail of metal coupled to the second RF feed via a first pin of the second metal spring bar; 2) a fourth rail of metal coupled to the second grounding point via a second pin of the second metal spring bar; and 3) two more elements disposed in parallel lines between the third rail and fourth second rail. The parallel lines are perpendicular to the length of the non-metal watchband. In this embodiment, the RF circuitry is operable to cause the second antenna structure to radiate electromagnetic energy in multiple frequency bands. These frequency bands can be similar or different frequency bands than those of the first antenna structure.

In another embodiment, a device may include a metal body and a first antenna structure formed as a ladder structure within a first end of a non-metal member that is affixed to the metal body via a first metal spring bar. The ladder structure may include 1) a first rail of metal coupled to the RF feed via a first pin of the first metal spring bar; 2) a second rail of metal coupled to the grounding point via a second pin of the second metal spring bar; and 3) two or more elements disposed in parallel lines between the first rail and the second rail. The parallel lines are perpendicular to the length of the non-metal member. In this embodiment, the RF circuitry is operable to cause the first antenna structure to radiate electromagnetic energy in multiple frequency bands, as described herein.

Figure 4:
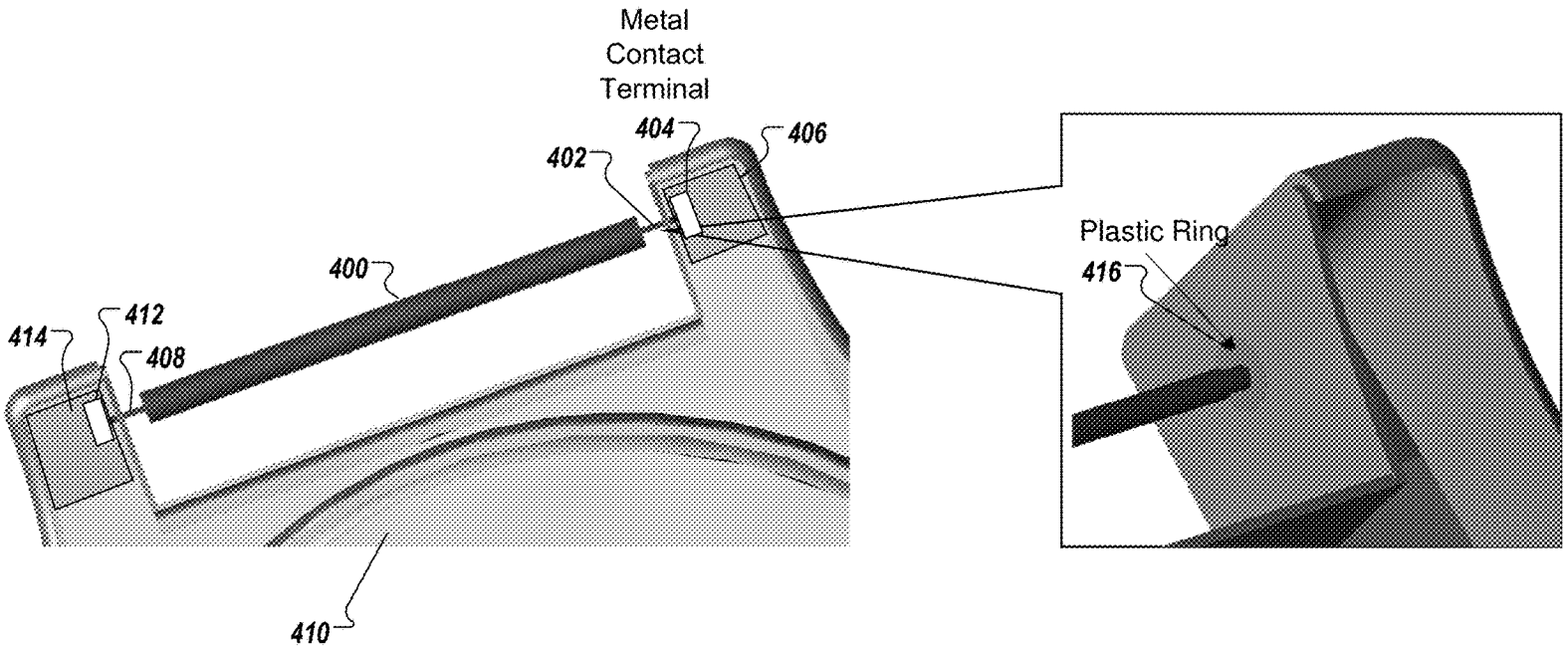
FIG. 4 is a back view of a spring bar connected with metal contact terminal of a printed circuit board disposed within a metal watch body according to one embodiment.

FIG. 4 is a back view of a spring bar 400 connected with metal contact terminal 404 of a printed circuit board (PCB) 406 disposed within a metal watch body 410 according to one embodiment. The spring bar 400 includes a first pin 402 that extends through a hole in the metal watch body 410 to directly connect to a metal contact terminal 404 disposed on the PCB 406. Remaining portions of the antenna structure (not illustrated in FIG. 4) are physically and electrically coupled to the spring bar 400. The spring bar 400 also includes a second pin 408 that extends through another hole in the metal watch body 410 to directly connect to a metal contact terminal 412 disposed on a second PCB 414. The first and second PCBs may be a single PCB, but are illustrated as two separate PCBs in FIG. 4. In another embodiment, the PCB 406 and PCB 414 may be one type of printed circuit boards, such as a rigid PCB (e.g., FR-4 substrate), and the RF circuitry, the processing device, or both can be disposed on another PCB. In another embodiment, portions of the PCB 406 or PCB 414 can be flexible. Alternatively, the metal contact terminal 412 can also be grounded to the metal watch body 410 itself, and the metal contact terminal 404 could be electrically isolated from the metal watch body 410. For example, a metal contact terminal 412 can be disposed on other portions of the metal watch body 410, instead of on a PCB, and can still make an electrical connection between the metal contact terminal 404 and other circuitry located at another location within the metal watch body 410. An example would be an insulated wire could be used to make an electrical connection between the metal contact terminal 404 and other circuitry within the metal watch body 410. In one embodiment, as depicted, a plastic ring 416 can be disposed to line the hole of the metal watch body 410 through with the first pin 402 passes. The plastic ring 416 can be used to electrically isolate the first pin 402 from the metal watch body 410. The other hole through with the second pin 408 passes may also include a plastic ring. In other embodiments, other dielectric material can be used to isolate the first pin 402 from the metal watch body 410. For example, the plastic ring 416 may be ceramic, glass, or any other non-conductive material. The spring bar 400 may be made up of conductive material entirely. In other embodiments, the spring bar 400 may include portions of conductive material and portions of non-conductive material. However, in these embodiments, an electrical connection will need to be made between the metal contact terminal 404 and other portions of the antenna structure via the first pin 402.

Figure 5:
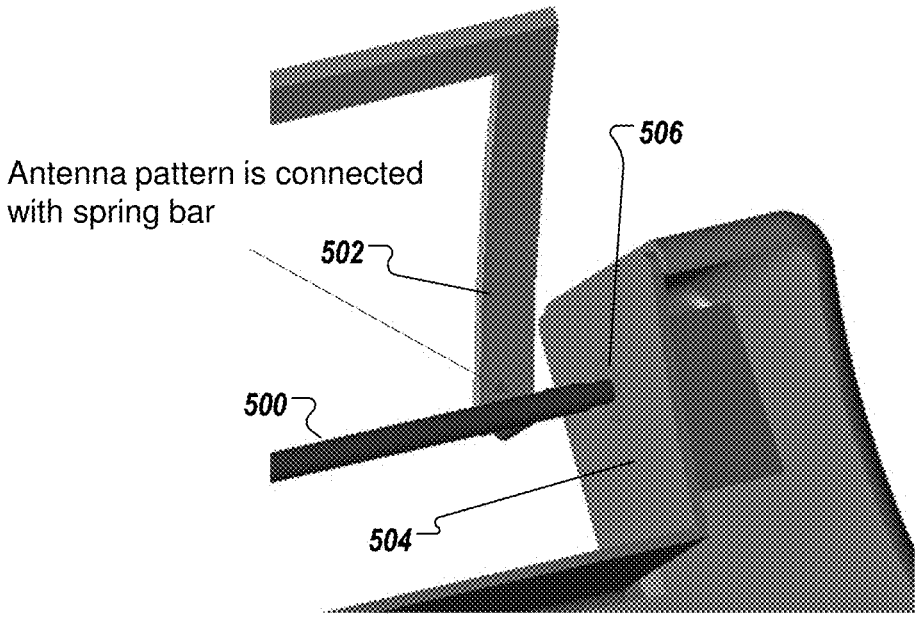
FIG. 5 is a perspective view of a spring bar and a first antenna element of an antenna structure that is not directly connected to a metal watch body according to another embodiment.

FIG. 5 is a perspective view of a spring bar 500 and a first antenna element 502 of an antenna structure that is not directly connected to a metal watch body 504 according to another embodiment. The spring bar 500 is a metal spring bar to which the first antenna element 502 is coupled. The spring bar 500 is electrically isolated from the metal watch body 504 using a dielectric material 506 that is disposed in a hole through with the spring bar 500 passes. For example, the spring bar 500 typically includes a pin that extends through the hole to mechanically couple the spring bar 500 to the metal watch body 504. The spring bar 500 can be fed through an opening in a watchband to affix a watchband (not illustrated in FIG. 5) to the metal watch body 504. The pin can pass through the hole to make an electrical connection with a metal contact terminal, such as an RF feed disposed on a PCB. Alternatively, the spring bar 500 can make an electrical connection with other electrical components or other conductive materials. The spring bar 500 can also provide the mechanical mechanism(s) to affix the watchband to the metal watch body 504 while providing an electrically isolated connection between the first antenna element 502 and the metal contact terminal.

Figure 6:
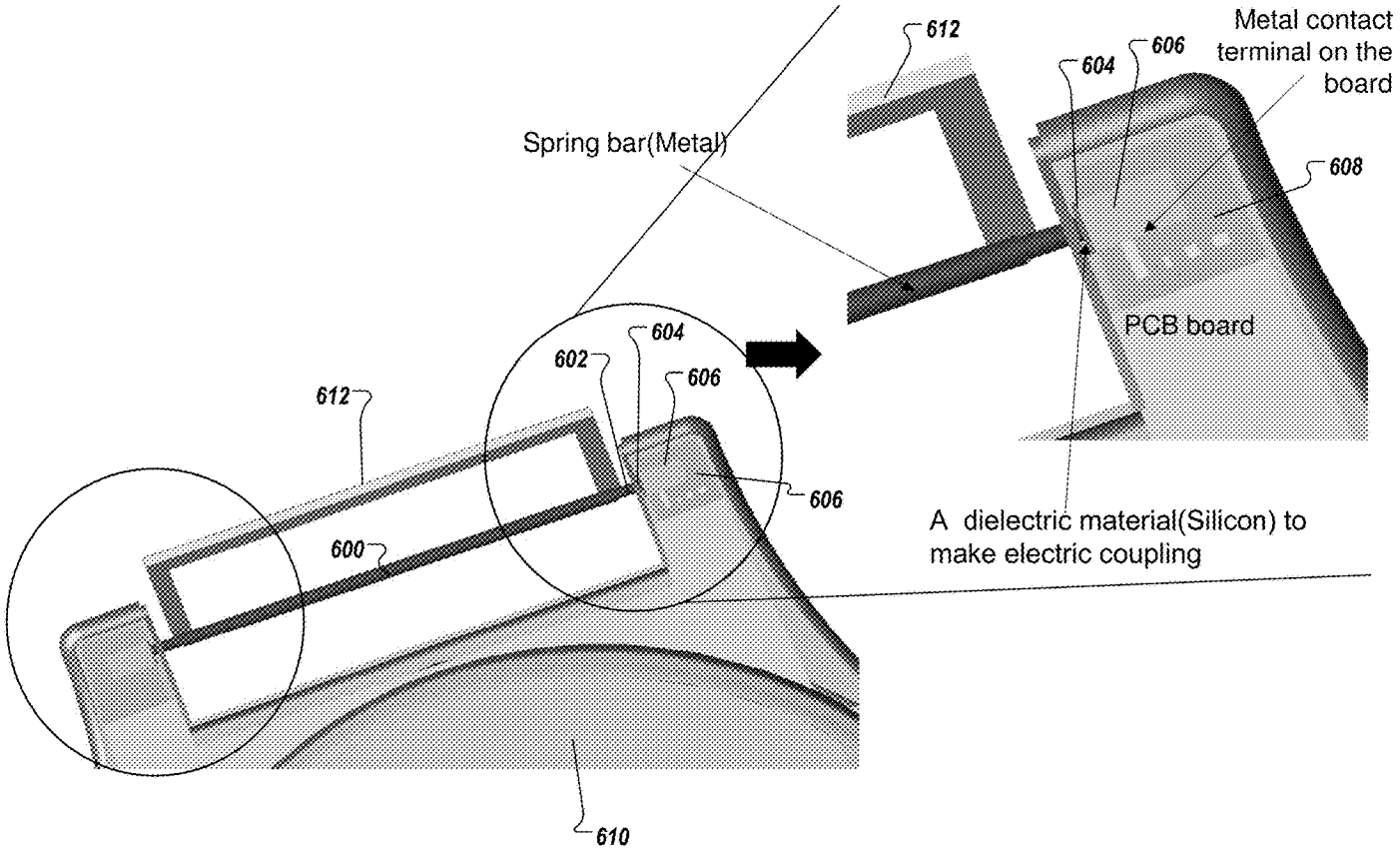
FIG. 6 is a back view of a spring bar that makes indirect contact with an antenna contact terminal according to one embodiment.

FIG. 6 is a back view of a spring bar 600 that makes indirect contact with an antenna contact terminal 606 according to one embodiment. The spring bar 600 includes a first pin 602 that extends through a hole in a metal watch body 610 to directly connect to a metal contact terminal 606 disposed on a PCB 608. A first antenna element 612 is physically and electrically coupled to the spring bar 600. In this embodiment, a dielectric component 604 disposed between the first pin 602 and the metal contact terminal 606 disposed on the PCB 606. The dielectric component 604 may line the inner surface of the hole to electrically isolate the first pin 602 from the metal watch body 610. The dielectric component 604 is designed to permit an indirect electric coupling (e.g., mutual coupling) between the first pin 602 and the metal contact terminal 606. Alternatively, a plastic ring (not illustrated) may also be used to electrically isolate the first pin 602 from the inner surface of the hole and the dielectric component 604 can provide the indirect electric coupling between the first pin 602 and the metal contact terminal 606.

Similarly, in other embodiments, an electric coupling can be made between a second pin of the spring bar 600 and a metal contact terminal through a hole on the other side of the spring bar 600. The other side may be grounded to the metal watch body 610. The spring bar 600 may be made up of conductive material entirely. In other embodiments, the spring bar 600 may include portions of conductive material and portions of non-conductive material. However, in these embodiments, an indirect electrical connection can be made between the metal contact terminal 606 and other portions of the antenna structure via the first pin 602.

It should be noted that other mechanical mechanisms could be used to make a mechanical connection between the watchband and the metal watch body through which an electrical connection can be made. Most watches includes a spring bar, but other wearable electronic devices may have another mechanical joint to facilitate movement between two bodies, and an electrical connection can be made through the mechanical joint in similar fashion as described above with respect to the spring bar.

Figure 7A:
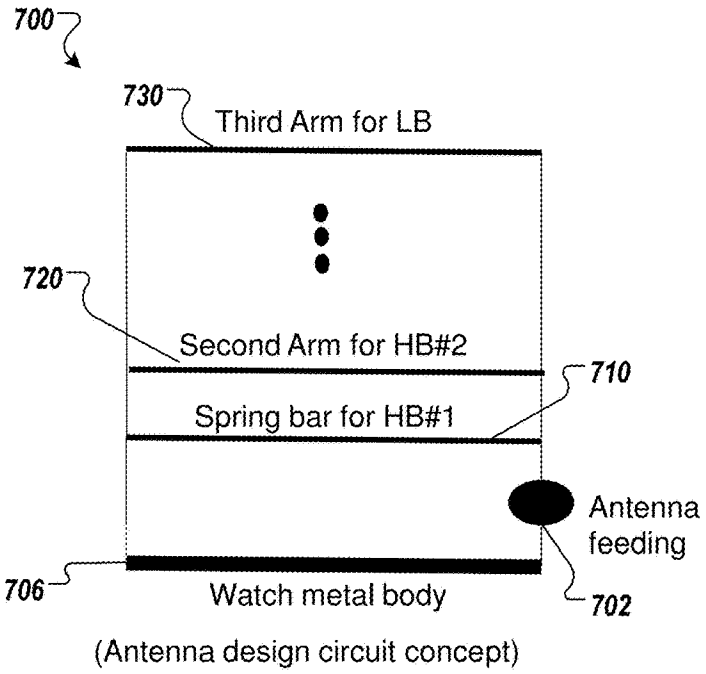
FIG. 7A is a schematic diagram of an antenna structure that makes direct contact with antenna contact terminals according to one embodiment.

FIG. 7A is a schematic diagram of an antenna structure 700 that makes direct contact with antenna contact terminals according to one embodiment. The antenna structure 700 is coupled to two antenna contact terminals. The first antenna contact terminal is a RF feed 702 used for feeding the antenna structure 700. The second antenna contact terminal is a grounding point 706. The antenna structure 700 includes three antenna elements, including a spring bar 710, a second arm 720, and a third arm 730. The antenna structure 700 is formed as a ladder structure as described herein. The antenna structure 700 can be embedded within a non-metal watchband affixed to a metal watch body via a spring bar 710. The second arm 720 and the third arm 730 are electrically coupled to the spring bar 710, and a first end of the spring bar 710 is electrically coupled to the RF feed 702. The first end of the spring bar 710 is directly connected to the antenna contact terminal, such as a metal contact terminal on a PCB as described herein. A second end of the spring bar 710 is electrically coupled to the grounding point 706. The second end of the spring bar 710 is directly connected to another antenna contact terminal, such as a metal contact terminal on a PCB as described herein. Alternatively, the second end of the spring bar 710 can be electrically coupled to the metal watch body. The direct connections described here may be similar to those described above with respect to FIG. 4.

Figure 7B:
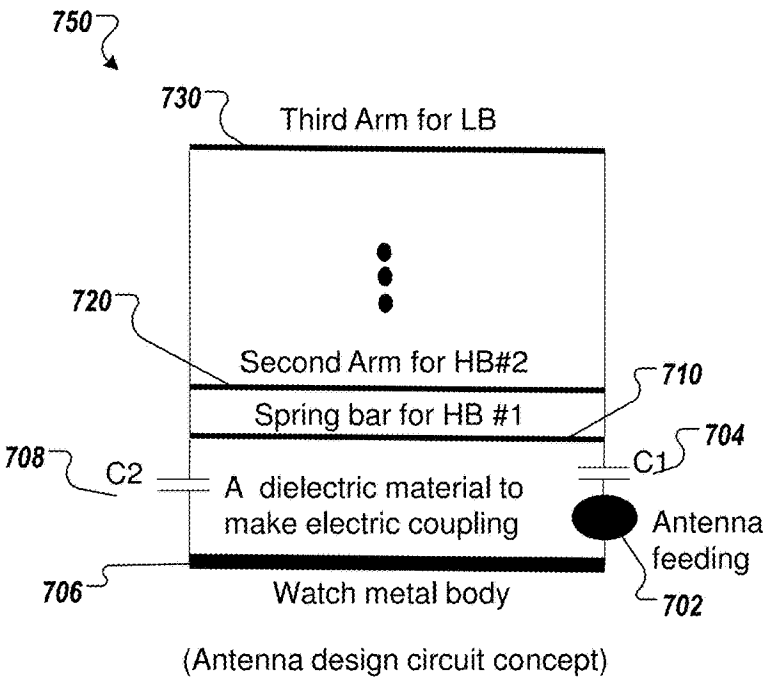
FIG. 7B is a schematic diagram of an antenna structure that makes indirect contact with antenna contact terminals according to one embodiment.

FIG. 7B is a schematic diagram of an antenna structure 750 that makes indirect contact with the antenna contact terminals according to one embodiment. The antenna structure 750 is similar to the antenna structure 700 as noted with similar reference labels. However, the antenna structure 750 makes indirect connections with the antenna contact terminals 702 and 706. In one embodiment, dielectric material can be disposed between a first end of the spring bar 710 and the RF feed 702. Dielectric material can also be disposed between a second end of the spring bar 710 and the grounding point 706. The dielectric material can form a capacitor between the two conductive nodes, i.e., the metal of the end of the spring bar 710 and the metal of the metal contact terminal of the RF feed 702. The capacitor permits an indirect electrical coupling (e.g., mutual coupling) between the antenna structure 750 and the RF circuitry.

In another embodiment, additional components can be disposed between the antenna structures 700, 750 and the RF circuitry, such as used for impedance matching or tuning of frequency bands.

Figures 8A, 8B, 8C, 8D, 8E, 8F, 8G, 8H, 8I:
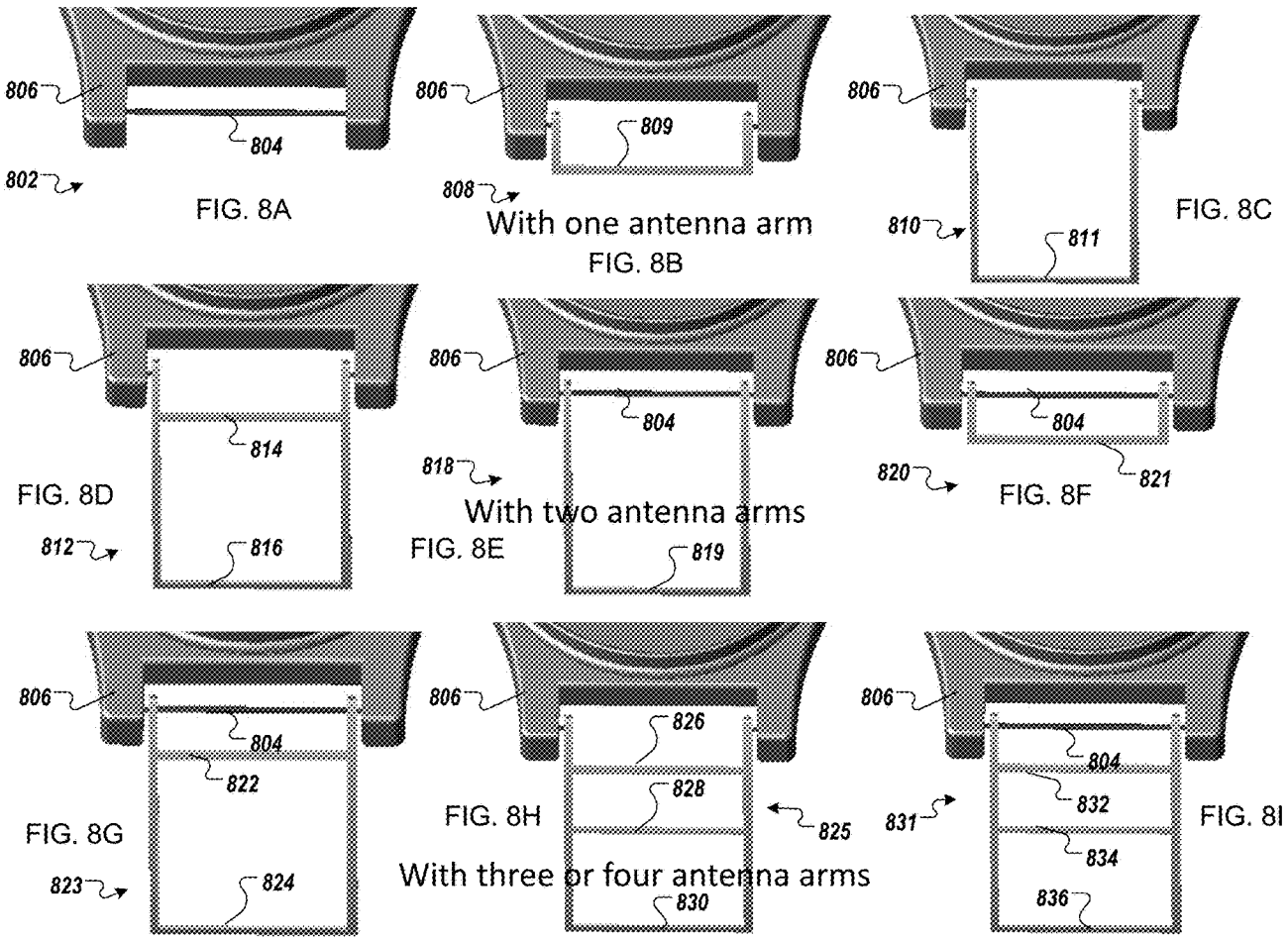
FIGS. 8A-8I are perspective views of ladder antenna structures according to multiple embodiments.

The embodiments described above illustrated and describe antenna structures including one to three antenna elements. The number of antenna elements may vary based on the particular design. The embodiments described below illustrate and describe some different arrangements of the spring bar, as well as the number of antenna elements that can be used. These embodiments may be ladder structures, U-shaped structures, L or inverted-L structures, or the like. FIGS. 8A-8I are perspective views of ladder antenna structures according to multiple embodiments. The embodiments of FIG. 8A-8C illustrate an antenna structure with one antenna arm. The embodiments of FIG. 8D-8F illustrate an antenna structure with two antenna arms. The embodiments of FIG. 8G-8I illustrate an antenna structure with three or four antenna arms.

FIG. 8A illustrates one embodiment of a ladder antenna structure 802 with a spring bar 804 disposed in a first axis of holes in a metal watch body 806. The spring bar 804 operates as a radiating element.

FIG. 8B illustrates one embodiment of a ladder antenna structure 808 with a spring bar 809 disposed in a second axis that is a distance away from the first axis of holes in the metal watch body 806. The spring bar 809 operates as a radiating element.

FIG. 8C illustrates one embodiment of a ladder antenna structure 810 with a spring bar 811 disposed in a third axis that is a distance away from the first axis of holes in the metal watch body 806. The third axis may be a greater distance away from the first axis than the second axis. The spring bar 811 operates as a radiating element.

FIG. 8D illustrates one embodiment of a ladder antenna structure 812 with a spring bar 814 disposed in a second axis that is a first distance away from the first axis of holes in the metal watch body 806. A second arm 816 is disposed in a third axis that is a second distance away from the first axis. The second distance may be greater than the first distance. The spring bar 814 and the second arm 816 operate as radiating elements. The embodiments of FIGS. 8B, 8C, and 8D can be considered as not having a spring bar at the first axis of holes in the metal watch body 806. In some cases, the other arms may be considered the spring bar.

FIG. 8E illustrates one embodiment of a ladder antenna structure 818 with a spring bar 804 disposed in the first axis of the holes in the metal watch body 806 and a second arm 819 disposed in a third axis that is a first distance away from the first axis. The spring bar 804 and the second arm 819 operate as radiating elements.

FIG. 8F illustrates one embodiment of a ladder antenna structure 820 with a spring bar 804 disposed in the first axis of the holes in the metal watch body 806 and a second arm 821 disposed in a second axis that is a first distance away from the first axis. The spring bar 804 and the second arm 821 operate as radiating elements. The third axis of FIG. 8G may be a greater distance away from the first axis than the second axis of FIG. 8F.

FIG. 8G illustrates one embodiment of a ladder antenna structure 823 with a spring bar 804 disposed in the first axis of the holes in the metal watch body 806, a second arm 822 disposed in a second axis that is a first distance away from the first axis, and a third arm 824 disposed in a third axis that is a second distance away from the first axis. The second distance is greater than the first distance. The spring bar 804, the second arm 822, and the third arm 824 operate as radiating elements.

FIG. 8H illustrates one embodiment of a ladder antenna structure 825 without a spring bar 804 disposed in the first axis of the holes in the metal watch body 806. The ladder antenna structure 825 includes a first arm 826 disposed in a second axis that is a first distance away from the first axis, a second arm 828 disposed in a second axis that is a second distance away from the first axis, and a third arm 830 disposed in a third axis that is a third distance away from the first axis. The third distance is greater than the second distance and the second distance is greater than the first distance. The first arm 826, the second arm 828, and the third arm 830 operate as radiating elements.

FIG. 8I illustrates one embodiment of a ladder antenna structure 831 with a spring bar 804 disposed in the first axis of the holes in the metal watch body 806. The ladder antenna structure 830 also includes a first arm 324 disposed in a second axis that is a first distance away from the first axis, a second arm 834 disposed in a second axis that is a second distance away from the first axis, and a third arm 836 disposed in a third axis that is a third distance away from the first axis. The third distance is greater than the second distance and the second distance is greater than the first distance. The spring bar 804, the first arm 826, the second arm 828, and the third arm 830 operate as radiating elements.

As described above, impedance matching components can be disposed in connection with the antenna structures and the RF circuitry. In some embodiments, the antenna mode impedance is very different in the first and second modes. The two modes can be matched to desired working bands of interest (e.g., 2.4 GHz). In one embodiment, the first mode is matched using a first impedance matching circuit and the second modes is matched using a second impedance matching circuit. In another embodiment, a single impedance matching circuit can be used to match both the first mode and the second mode. The impedance matching circuits operate to match an impedance of a respective antenna to an impedance of a RF circuit coupled to the respective antenna to radiate or receive electromagnetic energy in a specified frequency range. In some embodiments, the matching components are organized as an impedance matching network. An impedance matching network is any combination of components used to match an impedance of the radio to an impedance of the antenna structure in the respective mode. The impedance matching network may also be used to match impedance of the antenna structure in multiple resonant modes.

When the antenna structure includes multiple antenna elements that radiate in multiple resonant modes, a diplexer can be used to separate RF signals for the respective frequencies. For example, in one embodiment, a first antenna contact terminal can be coupled to a diplexer. The diplexer is coupled to a first path for RF signal in a HB and a second path for RF signals in a LB. A first impedance matching network can be disposed in the first path for RF signals in the HB. A second impedance matching network can be disposed in the second path for RF signals in the LB. A second antenna contact terminal can be coupled to a grounding point via an inductor component. In one embodiment, the inductor component has an inductance of 3.657 nH. The inductor component can be disposed within the housing of a metal watch body, such as on a PCB. Similarly, the diplexer and the one or more antenna matching networks can be disposed within the housing of the metal watch body, such as on the same PCB as the inductor or on a separate PCB than the inductor. In one embodiment, the impedance matching network may include one or more shunt capacitors and one or more series inductors. In one embodiment, three series inductors with inductances of 5.34 nH, 16.6 nH, and 15.6 nH may be used in connection with three shunt capacitors with capacitance of 0.1 pF, 0.677 pF, and 0.677 pF. Alternatively, other matching components in other arrangements may be used.

In another embodiment, a second diplexer can be used to separate RF signals in the WLAN or PAN frequency bands from those RF signals in the GPS frequency bands. For example, in one embodiment, a first antenna contact terminal can be coupled to a diplexer. The diplexer is coupled to a first path for RF signal in a WLAN/PAN frequency bands and a second path for RF signals in the GPS band. A first impedance matching network can be disposed in the first path for RF signals in the WLAN/PAN frequency bands. A second impedance matching network can be disposed in the second path for RF signals in the GPS band. A second antenna contact terminal can be coupled to a grounding point via an inductor component. In one embodiment, the inductor component has an inductance of 5.625 nH. The inductor component can be disposed within the housing of a metal watch body, such as on a PCB. In one embodiment, the impedance matching network may include one or more shunt capacitors and one or more series inductors. In one embodiment, a series inductor with an inductance of 2.61 nH is coupled in series with two series capacitors of capacitances of 1.1 pF may be used in connection with a shunt capacitor with a capacitance of 2.12 pF and two shunt inductors with inductances of 10 nH and 2.76 nH. Alternatively, other matching components in other arrangements may be used. In one embodiment, the second diplexer is used in connection with the second RF circuitry and the second antenna structure described herein, while the first diplexer is used in connection with the first RF circuitry and the first antenna structure described herein.

In another embodiment, a wearable electronic device includes a housing of conductive material and a band. RF circuitry is disposed within the housing and the RF circuitry includes an RF feed and a grounding point. An antenna structure is disposed on or within the band, and the antenna structure includes a first connector that extends out from a first side of the band and a second connector that extends out from a second side of the band. The first connector includes at least a portion of conductive material that is electrically coupled to the RF feed when the first connector is physically coupled to the housing and the second connector includes at least a portion of conductive material that is electrically coupled to the grounding point when the second connector is physically coupled to the housing. The first connector and the second connector are disposed on a first axis at or near a first end of the band. The grounding point is electrically coupled to the conductive material of the housing. A first antenna element is electrically coupled to at least the first connector. At least a portion of the first antenna element is disposed on a second axis that is equidistant to a first edge of the housing where the first end of the band is physically coupled to the housing via the first connector and the second connector. The RF circuitry is operable to cause a first current flow on at least the first antenna element via the first connector to radiate electromagnetic energy in a first frequency range.

In another embodiment, the wearable electronic device includes a spring bar having a first pin and a second pin, where the first pin is the first connector and the second pin is the second connector. In some embodiments, the spring bar includes the first antenna element that is coupled between the first connector and the second connector on the first axis. In these embodiments, the spring bar operates as a radiator. In other embodiments, the spring bar may provide an electrical connection to the first antenna element, but does not radiate, such as spring bar that is not completely made of conductive material.

In a further embodiment, the antenna structure further comprises a second antenna element electrically coupled to at least the first connector. At least a portion of the second antenna element is disposed on a third axis that is equidistant to the first edge. The RF circuitry is operable to cause a second current flow on at least the second antenna element via the first connector to radiate electromagnetic energy in a second frequency range. A first distance between the second axis and the first edge is less than a second distance between the third axis and the first edge. The second frequency range may be different than the first frequency range. For example, given the length of the second antenna element, the second frequency range can be a lower frequency range than the first frequency range.

As described herein, the wearable electronic device may be a smartwatch having a metal watch body and a non-metal watchband. In some embodiments, the spring bar that affixes the metal watch body to the non-metal watchband can provide both a mechanical connection between the metal watch body and the non-metal watchband and an electrical connection between the antenna structure, disposed on or within the non-metal watchband, and the RF circuitry disposed within a housing of the metal watch body.

In a further embodiment, the wearable electronic device includes second RF circuitry disposed within the housing. The second RF circuitry includes a second RF feed and a second grounding point. A second antenna structure is disposed in the band and is coupled to the second RF circuitry via a third connector and a fourth connector. The third connector extends out from the first side of the band and includes at least a portion of conductive material that is electrically coupled to the second RF feed when the third connector is physically coupled to the housing. The fourth connector extends out from the second side of the band and includes at least a portion of conductive material that is electrically coupled to the second grounding point when the fourth connector is physically coupled to the housing. The third connector and the fourth connector are disposed on a fourth axis at or near a second end of the band. Similar to the grounding point described above, the second grounding point is electrically coupled to the conductive material of the housing. A third antenna element is electrically coupled to at least the third connector. At least a portion of the third antenna element is disposed on a fifth axis that is equidistant to a second edge of the housing where the second end of the band is physically coupled to the housing via the third connector and the fourth connector. During operation, the second RF circuitry is operable to cause a third current flow on at least the third antenna element via the third connector to radiate electromagnetic energy in a third frequency range.

In a further embodiment, the second antenna structure further includes a fourth antenna element electrically coupled to at least the third connector. At least a portion of the fourth antenna element is disposed on a sixth axis that is equidistant to the second edge where the second end of the band is physically coupled to the housing via the third connector and the fourth connector. During operation, the second RF circuitry is operable to cause a fourth current flow on at least the fourth antenna element via the third connector to radiate electromagnetic energy in a fourth frequency range. In a further embodiment, the second antenna structure can include a second spring bar with a first pin, a second pin, and the third antenna element coupled between them. The third antenna element can be disposed in the same axis as the holes as described herein, or can be disposed in another axis that is a distance away from the axis of the holes.

In one embodiment, the antenna structure includes a first arm, a second arm, and a third arm. In another embodiment, the antenna structure includes the first arm, the second arm, the third arm, and a fourth arm. During operation, the RF circuitry causes a first current flow on the spring bar to radiate electromagnetic energy in the first frequency range, causes a second current flow on the first arm, second arm, and the third arm to collectively radiate electromagnetic energy in a second frequency range. In embodiments with the fourth arm, the RF circuitry causes a third current flow on the first arm, second arm, and the fourth arm to collectively radiate electromagnetic energy in a third frequency range.

Figure 9:
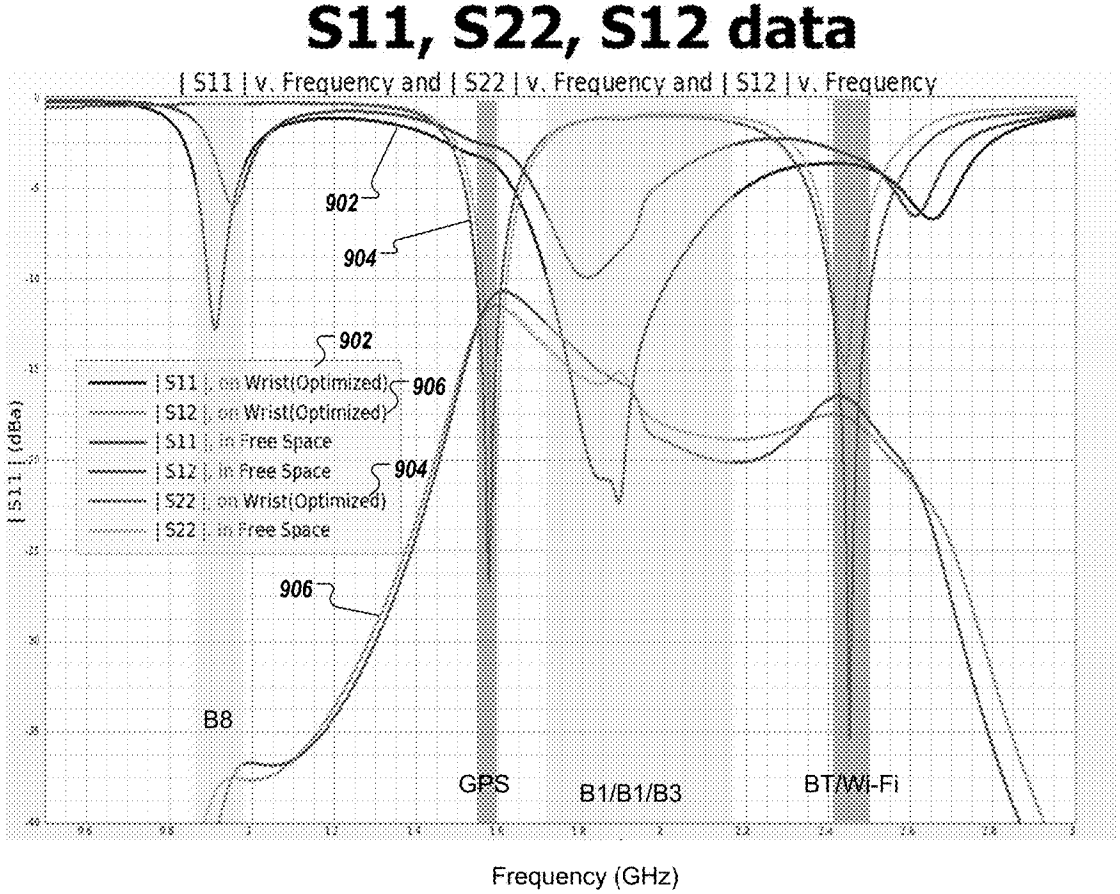
FIG. 9 illustrates an impedance matching network coupled to the ladder antenna structure according to one embodiment.

FIG. 9 is a graph of the $S_{11}$ parameter, $S_{22}$ parameter, and $S_{12}$ parameter according to one embodiment. An S-parameter is the input-output relationship between terminals (or ports) of an electrical system like antenna system. In this embodiment, we have a communication system with two radios including each RF circuitry in a wearable device. The each radio terminal deliver RF power to the each antenna. A first radio has a ladder antenna structure that communicates with second radio. The graph 900 shows the $S_{11}$ parameter 902 of the ladder antenna structure. The $S_{11}$ parameter 902, also referred to as the reflection coefficient, represents the reflected power from the ladder antenna structure. $S_{11}$ parameter 902 also represents the power the first radio (terminal 1) is attempting to deliver to the antenna structure. The graph 900 also shows the $S_{22}$ parameter 904 of the ladder antenna structure. The $S_{22}$ parameter 904, also referred to as the reflection coefficient, represents the reflected power from the ladder antenna structure. $S_{22}$ parameter 904 also represents the power the second radio (terminal 2) is attempting to deliver to the antenna structure. For example, the $S_{22}$ parameter 904 represents the power being delivered to the RF circuitry from the antenna structure. The graph 900 also shows the $S_{12}$ parameter 906 between two radio terminals. The $S_{12}$ parameter 906 represents the S21 represents the power transferred from the second radio (terminal 2) to the first radio (terminal 1) through the ladder antenna structure.

In one embodiment, the first antenna structure and the second antenna structure embedded within a watchband may include the following system efficiencies for the noted frequency bands while the watchband is disposed on a wrist of a user.

| First Antenna Structure on Wrist | 880 MHz | 960 MHz | 1.71 GHz | 1.88 GHz | 1.92 GHz | 2.17 GHz |
|---|---|---|---|---|---|---|
| System efficiency (dB) | −14.0 | −14.0 | −9.9 | −8.1 | −8.27 | −9.93 |
| Second Antenna Structure on Wrist | 1.563 GHz | 1.575 GHz | 1.587 GHz | 2.4 GHz | 2.48 GHz | |
| System efficiency (dB) | −11.03 | −10.87 | −10.89 | −10.01 | −9.47 | |

Alternatively, other efficiencies may be achieved for these frequency bands, as well as other frequency bands.

Figure 10:
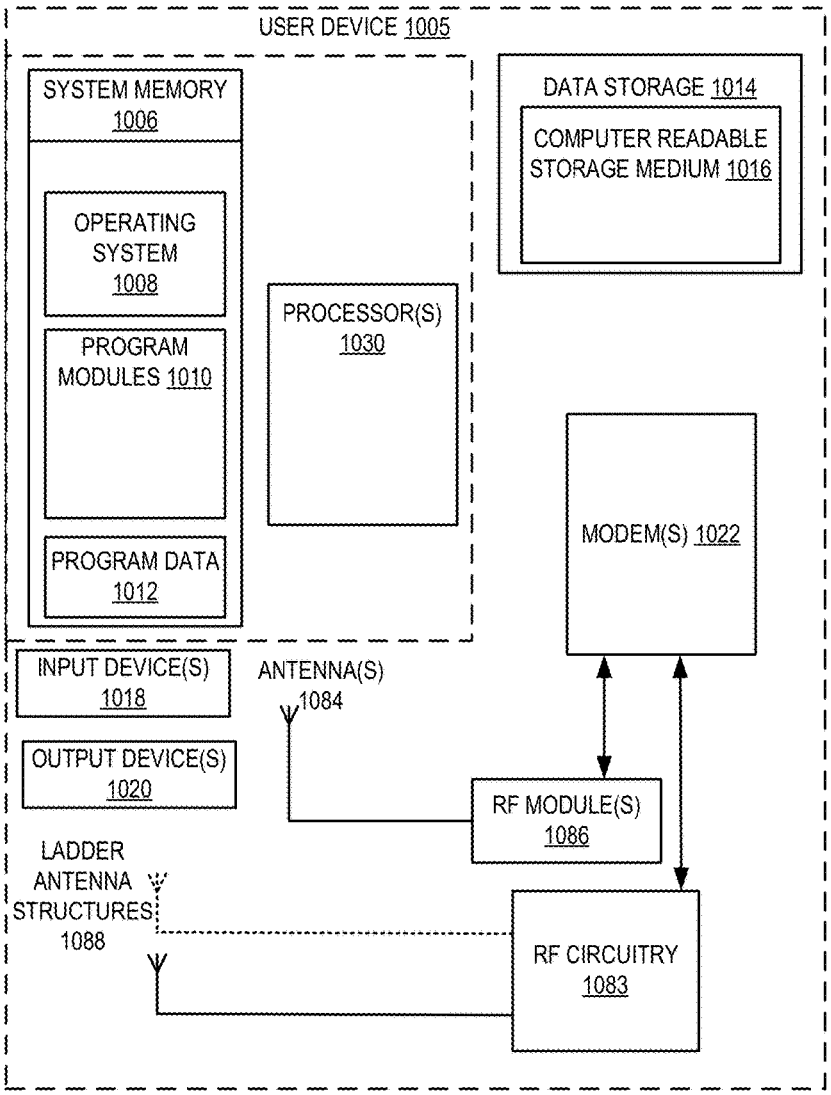
FIG. 10 is a block diagram of a user device in which embodiments of embedded ladder antenna structures may be implemented.

FIG. 10 is a block diagram of a user device 1005 in which embodiments of embedded ladder antenna structures may be implemented. The user device 1005 may correspond to the smartwatch 100 of FIG. 1 or the smartwatches described in FIG. 2-9. Alternatively, the user device may be other wearable electronic devices, as described herein. The user device 1005 may be any portable user device that includes a band or other mechanism used to affix to a user.

The user device 1005 includes one or more processor(s) 1030, such as one or more CPUs, microcontrollers, field programmable gate arrays, or other types of processors. The user device 1005 also includes system memory 1006, which may correspond to any combination of volatile and/or non-volatile storage mechanisms. The system memory 1006 stores information that provides operating system component 1008, various program modules 1010, program data 1012, and/or other components. In one embodiment, the system memory 1006 stores instructions of methods to control operation of the user device 1005. The user device 1005 performs functions by using the processor(s) 1030 to execute instructions provided by the system memory 1006.

The user device 1005 also includes a data storage device 1014 that may be composed of one or more types of removable storage and/or one or more types of non-removable storage. The data storage device 1014 includes a computer-readable storage medium 1016 on which is stored one or more sets of instructions embodying any of the methodologies or functions described herein. Instructions for the program modules 1010 may reside, completely or at least partially, within the computer-readable storage medium 1016, system memory 1006 and/or within the processor(s) 1030 during execution thereof by the user device 1005, the system memory 1006 and the processor(s) 1030 also constituting computer-readable media. The user device 1005 may also include one or more input devices 1018 (keyboard, mouse device, specialized selection keys, etc.) and one or more output devices 1020 (displays, printers, audio output mechanisms, etc.).

The user device 1005 further includes a modem 1022 to allow the user device 1005 to communicate via a wireless network (e.g., such as provided by the wireless communication system) with other computing devices, such as remote computers, an item providing system, and so forth. The modem 1022 can be connected to RF circuitry 1083 and zero or more RF modules 1086. The RF circuitry 1083 may be a WLAN module, a WAN module, PAN module, or the like. Ladder antenna structures, generally referred to herein as antennas 1088, are coupled to the RF circuitry 1083, which is coupled to the modem 1022. Zero or more antennas 1084 can be coupled to one or more RF modules 1086, which are also connected to the modem 1022. The zero or more antennas 1084 may be GPS antennas, NFC antennas, other WAN antennas, WLAN or PAN antennas, or the like. The modem 1022 allows the user device 1005 to handle both voice and non-voice communications (such as communications for text messages, multimedia messages, media downloads, web browsing, etc.) with a wireless communication system. The modem 1022 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 1022 may generate signals and send these signals to pattern diversity antennas 1088, and 1084 via RF circuitry 1083, and RF module(s) 1086 as descried herein. User device 1005 may additionally include a WLAN module, a GPS receiver, a PAN transceiver and/or other RF modules. These RF modules may additionally or alternatively be connected to one or more of antennas 1084, 1088. Antennas 1084, 1088 may be configured to transmit in different frequency bands and/or using different wireless communication protocols. The antennas 1084, 1088 may be directional, omnidirectional, or non-directional antennas. In addition to sending data, antennas 1084, 1088 may also receive data, which is sent to appropriate RF modules connected to the antennas. One of the antennas 1084, 1088 may be any combination of the antenna structures described herein.

In one embodiment, the user device 1005 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna structure and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 1022 is shown to control transmission and reception via antenna (1084, 1088), the user device 1005 may alternatively include multiple modems, each of which is configured to transmit/receive data via a different antenna and/or wireless transmission protocol.

The user device 1005 delivers and/or receives items, upgrades, and/or other information via the network. For example, the user device 1005 may download or receive items from an item providing system. The item providing system receives various requests, instructions and other data from the user device 1005 via the network. The item providing system may include one or more machines (e.g., one or more server computer systems, routers, gateways, etc.) that have processing and storage capabilities to provide the above functionality. Communication between the item providing system and the user device 1005 may be enabled via any communication infrastructure. One example of such an infrastructure includes a combination of a WAN and wireless infrastructure, which allows a user to use the user device 1005 to purchase items and consume items without being tethered to the item providing system via hardwired links. The wireless infrastructure may be provided by one or multiple wireless communications systems, such as one or more wireless communications systems. One of the wireless communication systems may be a WLAN hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 1005.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public WAN such as the Internet.

The user devices 1005 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1005 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A smartwatch comprising:

a metal watch body;

a non-metal watchband, wherein a first end of the non-metal watchband is affixed to the metal watch body via a first metal spring bar;

a processor disposed within the metal watch body;

radio frequency (RF) circuitry disposed within the metal watch body and coupled to the processor;

a first antenna structure embedded within the non-metal watchband and electrically coupled to the RF circuitry via the first metal spring bar, wherein the first antenna structure comprises:

a first arm that extends along a first line that is equidistant from a first side of the non-metal watchband;

a second arm that extends along a second line that is equidistant from a second side of the non-metal watchband;

a third arm that extends along a third line that is equidistant from an axis of the first metal spring bar; and a fourth arm that extends along a fourth line that is equidistant from the axis of the first metal spring bar, wherein the fourth arm is disposed at a greater distance from the first metal spring bar than the third arm, wherein the RF circuitry causes a first current flow on a portion of the first arm, a portion of the second arm, the third arm and a first portion of the metal watch body to collectively radiate electromagnetic energy in a first frequency range, wherein the RF circuitry causes a second current flow on the first arm, the second arm, the fourth arm, and the first portion of the metal watch body to collectively radiate electromagnetic energy in a second frequency range, and wherein the second frequency range is lower than the first frequency range.

2. The smartwatch of claim 1, further comprising:

a second metal spring bar, wherein a second end of the non-metal watchband is affixed to the metal watch body via the second metal spring bar; and a second antenna structure embedded within the non-metal watchband and electrically coupled to the RF circuitry via the second metal spring bar, wherein the second antenna structure comprises:

a fifth arm that extends along a fifth line that is equidistant from the first side of the non-metal watchband;

a sixth arm that extends along a sixth line that is equidistant from the second side of the non-metal watchband;

a seventh arm that extends along a seventh line that is equidistant from an axis of the second metal spring bar; and an eighth arm that extends along an eighth line that is equidistant from the axis of the second metal spring bar, wherein the eighth arm is disposed at a greater distance from the second metal spring bar than the seventh arm, wherein the RF circuitry is operable to cause a third current flow on a portion of the fifth arm, a portion of the sixth arm, the seventh arm, and a second portion of the metal watch body to collectively radiate electromagnetic energy in a third frequency range, wherein the RF circuitry is operable to cause a fourth current flow on the fifth arm, the seventh arm, the eighth arm, and the second portion of the metal watch body to collectively radiate electromagnetic energy in a fourth frequency range, and wherein the fourth frequency range is lower than the third frequency range.

3. The smartwatch of claim 2, wherein the RF circuitry comprises:

a wireless area network (WAN) module coupled to the first antenna structure via the first metal spring bar, wherein the WAN module is operable to cause the first antenna structure to radiate electromagnetic energy in the first frequency range, the second frequency range, or both concurrently, wherein the first frequency range and the second frequency range are WAN frequency bands; and a wireless local area network (WLAN) module coupled to the second antenna structure via the second metal spring bar, wherein the WLAN module is operable to cause the second antenna structure to radiate electromagnetic energy in the third frequency range, the fourth frequency range, or both concurrently, wherein the third frequency range and the fourth frequency range are WLAN frequency bands.

4. The smartwatch of claim 2, wherein:

the first antenna structure comprises a ninth arm that extends along an ninth line that is equidistant from the axis of the first metal spring bar, wherein the ninth arm is disposed at a greater distance from the first spring metal bar than the fourth arm, and the second antenna structure comprises a tenth arm that extends along a tenth line that is equidistant from the axis of the second metal spring bar, wherein the tenth arm is disposed at a greater distance from the second spring metal bar than the eighth arm.

5. The smartwatch of claim 4, wherein the RF circuitry comprises:

a wireless area network (WAN) module coupled to the first antenna structure via the first metal spring bar, wherein the WAN module is operable to cause the first antenna structure to radiate electromagnetic energy in the first frequency range, the second frequency range, a fifth frequency range, or any combination thereof concurrently, wherein the first frequency range, the second frequency range, and the fifth frequency range are WAN frequency bands;

a wireless local area network (WLAN) module coupled to the second antenna structure via the second metal spring bar, wherein the WLAN module is operable to cause the second antenna structure to radiate electromagnetic energy in the third frequency range, the fourth frequency range, or both concurrently, wherein the third frequency range and the fourth frequency range are WLAN frequency bands; and a global positioning system (GPS) module coupled to the second antenna structure via the second metal spring bar, wherein the GPS module is operable to cause the second antenna structure to radiate electromagnetic energy in a sixth frequency range, wherein the sixth frequency range is a GPS frequency band.

6. A wearable electronic device comprising:

a housing comprising conductive material;

a band;

radio frequency (RF) circuitry disposed within the housing, wherein the RF circuitry comprises an RF feed and a grounding point; and an antenna structure disposed on or within the band, wherein the antenna structure comprises:

a first connector that extends out from a first side of the band, wherein the first connector comprises at least a portion of conductive material that is electrically coupled to the RF feed when the first connector is physically coupled to the housing;

a second connector that extends out from a second side of the band; wherein the second connector comprises at least a portion of conductive material that is electrically coupled to the grounding point when the second connector is physically coupled to the housing, wherein the first connector and the second connector are disposed on a first axis at or near a first end of the band, wherein the grounding point is electrically coupled to the conductive material of the housing; and a first antenna element electrically coupled to at least the first connector, wherein at least a portion of the first antenna element is disposed on a second axis that is equidistant to a first edge of the housing where the first end of the band is physically coupled to the housing via the first connector and the second connector, and wherein the RF circuitry is operable to cause a first current flow on at least the first antenna element via the first connector to radiate electromagnetic energy in a first frequency range.

7. The wearable electronic device of claim 6, further comprising a spring bar having a first pin and a second pin, wherein the first pin is the first connector and the second pin is the second connector.

8. The wearable electronic device of claim 6, further comprising a spring bar having a first pin, a second pin, and the first antenna element, the first antenna element being coupled between the first connector and the second connector on the first axis, and wherein the second axis is the same as the first axis.

9. The wearable electronic device of claim 6, wherein the antenna structure further comprises a second antenna element electrically coupled to at least the first connector, wherein at least a portion of the second antenna element is disposed on a third axis that is equidistant to the first edge, wherein the RF circuitry is operable to cause a second current flow on at least the second antenna element via the first connector to radiate electromagnetic energy in a second frequency range, wherein the second frequency range is different than the first frequency range, and wherein a first distance between the second axis and the first edge is less than a second distance between the third axis and the first edge.

10. The wearable electronic device of claim 9, further comprising a spring bar having a first pin, a second pin, and the first antenna element, the first antenna element being coupled between the first connector and the second connector, wherein the second axis is the same as the first axis.

11. The wearable electronic device of claim 6, wherein the antenna structure further comprises a spring bar having a first pin, a second pin, and the first antenna element, the first antenna element being coupled between the first connector and the second connector on the first axis, wherein the second axis is the same as the first axis, wherein the housing is a metal watch body and the band is a non-metal watchband, and wherein the spring bar is disposed at the first end of the non-metal watchband.

12. The wearable electronic device of claim 11, wherein the antenna structure further comprises a second antenna element electrically coupled to at least the first connector, wherein at least a portion of the second antenna element is disposed on a third axis that is equidistant to the first edge of the housing where the first end of the band is physically coupled to the housing via the first connector and the second connector, and wherein the RF circuitry is operable to cause a second current flow on at least the second antenna element via the first connector to radiate electromagnetic energy in a second frequency range.

13. The wearable electronic device of claim 12, further comprising:

second RF circuitry disposed within the housing, wherein the second RF circuitry comprises a second RF feed and a second grounding point; and a second antenna structure, wherein the second antenna structure comprises:

a third connector that extends out from the first side of the band, wherein the third connector comprises at least a portion of conductive material that is electrically coupled to the second RF feed when the third connector is physically coupled to the housing;

a fourth connector that extends out from the second side of the band; wherein the fourth connector comprises at least a portion of conductive material that is electrically coupled to the second grounding point when the fourth connector is physically coupled to the housing, wherein the third connector and the fourth connector are disposed on a fourth axis at or near a second end of the band, wherein the second grounding point is electrically coupled to the conductive material of the housing; and a third antenna element electrically coupled to at least the third connector, wherein at least a portion of the third antenna element is disposed on a fifth axis that is equidistant to a second edge of the housing where the second end of the band is physically coupled to the housing via the third connector and the fourth connector, and wherein the second RF circuitry is operable to cause a third current flow on at least the third antenna element via the third connector to radiate electromagnetic energy in a third frequency range.

14. The wearable electronic device of claim 13, wherein the second antenna structure further comprises a fourth antenna element electrically coupled to at least the third connector, wherein at least a portion of the fourth antenna element is disposed on a sixth axis that is equidistant to the second edge where the second end of the band is physically coupled to the housing via the third connector and the fourth connector, and wherein the second RF circuitry is operable to cause a fourth current flow on at least the fourth antenna element via the third connector to radiate electromagnetic energy in a fourth frequency range.

15. The wearable electronic device of claim 13, wherein the antenna structure further comprises a first spring bar having a first pin, a second pin, and the first antenna element, the first antenna element being coupled between the first connector and the second connector on the first axis, wherein the second axis is the same as the first axis, wherein the second antenna structure further comprises a second spring bar having a third pin, a fourth pin, and the third antenna element, the third antenna element being coupled between the third connector and the fourth connector on the fourth axis, wherein the fifth axis is the same as the fourth axis, wherein the housing is a metal watch body and the band is a non-metal watchband, wherein the spring bar is disposed at the first end of the non-metal watchband, and wherein the second spring bar is disposed at the second end of the non-metal watchband.

16. The wearable electronic device of claim 6, further comprising a spring bar having a first pin, a second pin, and the first antenna element, the first antenna element being coupled between the first connector and the second connector on the first axis, and wherein the second axis is the same as the first axis, wherein the antenna structure further comprises:

a first arm that extends along a first line that is equidistant from the first side of the band;

a second arm that extends along a second line that is equidistant from the second side of the band; and a third arm that extends along a third line that is equidistant from the first axis, wherein the RF circuitry causes a first current flow on the spring bar to radiate electromagnetic energy in the first frequency range, and wherein the RF circuitry causes a second current flow on the first arm, second arm, and the third arm to collectively radiate electromagnetic energy in a second frequency range.

17. The wearable electronic device of claim 16, wherein the antenna structure further comprises a fourth arm that extends along a fourth line that is equidistant from the first axis, wherein the fourth arm is disposed at a greater distance from the first axis than the third arm, wherein the RF circuitry causes a fourth current flow on the first arm, second arm, and the fourth arm to collectively radiate electromagnetic energy in a third frequency range.

18. A device comprising:

a metal body;

a non-metal member, wherein a first end of the non-metal member is affixed to the metal body via a first metal spring bar;

a processor disposed within the metal body;

radio frequency (RF) circuitry disposed within the metal body and coupled to the processor, wherein the RF circuitry comprises an RF feed and a grounding point; and a first antenna structure formed as a ladder structure within the non-metal member, wherein the ladder structure comprises:

a first rail of metal coupled to the RF feed via a first pin of the first metal spring bar;

a second rail of metal coupled to the grounding point via a second pin of the first metal spring bar; and a plurality of elements disposed in parallel lines between the first rail and the second rail, wherein the parallel lines are perpendicular to a length of the non-metal member, wherein the RF circuitry is operable to cause the first antenna structure to radiate electromagnetic energy in a plurality of frequency bands.

19. The device of claim 18, wherein a second end of the non-metal member is affixed to the metal body via a second metal spring bar, wherein the RF circuitry comprises a second RF feed and a second grounding point, wherein the device further comprises a second antenna structure formed as a second ladder structure within the non-metal member, wherein the second ladder structure comprises:

a third rail of metal coupled to the second RF feed via a first pin of the second metal spring bar;

a fourth rail of metal coupled to the second grounding point via a second pin of the second metal spring bar; and a second plurality of elements disposed in parallel lines between the third rail and fourth second rail, wherein the parallel lines are perpendicular to the length of the non-metal member, wherein the RF circuitry is operable to cause the second antenna structure to radiate electromagnetic energy in a second plurality of frequency bands.

20. The device of claim 19, wherein the RF circuitry comprise:

a wireless area network (WAN) module coupled to the first antenna structure via the first metal spring bar, wherein the WAN module is operable to cause the first antenna structure to radiate electromagnetic energy in one or more WAN frequency bands; and a wireless local area network (WLAN) module coupled to the second antenna structure via the second metal spring bar, wherein the WLAN module is operable to cause the second antenna structure to radiate electromagnetic energy in one or more WLAN frequency bands.

* * * * *